US006554057B1

(12) United States Patent
Arnold et al.

(10) Patent No.: US 6,554,057 B1
(45) Date of Patent: Apr. 29, 2003

(54) METHOD FOR MONITORING A PROCESS DURING METAL DIE CASTING OR THIXOTROPIC MOULDING

(75) Inventors: Grégoire Arnold, Miège (CH); Christophe Bagnoud, Veyras (CH); Mirsolaw Plata, Vétroz (CH)

(73) Assignee: Alcan Technology & Management Ltd., Neuhausen am Rheinfall (CH)

( * ) Notice: Subject to any disclaimer, the term of this patent is extended or adjusted under 35 U.S.C. 154(b) by 0 days.

(21) Appl. No.: 10/048,276

(22) PCT Filed: Jul. 20, 2000

(86) PCT No.: PCT/CH00/00394

§ 371 (c)(1),
(2), (4) Date: Jan. 28, 2002

(87) PCT Pub. No.: WO01/07184

PCT Pub. Date: Feb. 1, 2001

(30) Foreign Application Priority Data

Jul. 27, 1999 (GB) ..... 99810679

(51) Int. Cl.[7] ..... B22D 17/32
(52) U.S. Cl. ..... 164/457; 164/900; 164/113
(58) Field of Search ..... 164/457, 900, 164/113, 312, 155.3, 155.5

(56) References Cited

U.S. PATENT DOCUMENTS 4,066,189 A * 1/1978 Toyoaki et al. ..... 222/334
5,052,468 A * 10/1991 Koenig ..... 164/457
5,133,910 A 7/1992 Manabe et al. ..... 264/40.4
5,758,707 A 6/1998 Jung et al. ..... 164/4.1
6,325,954 B1 * 12/2001 Sasaki et al. ..... 264/40.1

FOREIGN PATENT DOCUMENTS

| | | |
|---|---|---|
| DE | 30 43 369 | 6/1982 |
| DE | 41 08 992 | 9/1991 |
| EP | 228 799 | 7/1987 |

* cited by examiner

*Primary Examiner*—Tom Dunn
*Assistant Examiner*—I. H. Lin
(74) *Attorney, Agent, or Firm*—Klaus P. Stoffel

(57) ABSTRACT

A method for process monitoring during diecasting or thixotropic molding of metals in a diecasting or thixotropic molding installation which contains a casting chamber, a casting piston and a mould with a mold cavity. The method includes measuring temporal development of molding pressure p(t), determining time-related speed of the casting piston v(t); calculating energy E(t) supplied by the casting piston as a function of process time t, and calculating total energy $E_{tot}$ supplied by the casting piston during the diecasting or thixotropic molding process based on time-related development of the moulding pressure p(t) and the casting piston speed v(t), and using the total energy $E_{tot}$ as a parameter for monitoring the diecasting or thixotropic molding process.

12 Claims, 4 Drawing Sheets

METHOD FOR MONITORING A PROCESS DURING METAL DIE CASTING OR THIXOTROPIC MOULDING

BACKGROUND OF THE INVENTION

The invention relates to a method for process monitoring during diecasting or thixotropic moulding of metals. The invention also relates to a metal diecasting or thixotropic moulding device.

In the car industry in particular, increasingly high demands are made on tolerances and on the mechanical properties of diecastings and thixotropic mouldings. In order to meet these high quality demands, the most comprehensive degree of monitoring of the method parameters and their reproducibility are of great importance.

In order to monitor a diecasting or thixotropic moulding process, firstly the condition of the metal introduced into the casting chamber and secondly the parameters of the diecasting or thixotropic moulding process are decisive. In order to optimise the diecasting or thixotropic moulding process and to evaluate all parameters which are critical for process stability and reproducibility, as far as possible all parameters which can affect the process need to be covered.

A key factor for achievement of high reproducibility and process stability is the condition of the thixotropic metal rod and the diecasting alloy on introduction into the casting chamber, whereby the temperature of the thixotropic rod or the diecasting alloy represents a very important parameter.

In order to check and monitor the diecasting or thixotropic moulding process, temperature measurements may be undertaken in the alloy melt and inside the thixotropic metal rod during the heating process, whereby the temperature distribution may for example be determined using thermoelements at various melt or rod positions (inside the rod and around the rod edge), Habitually the heating curves, i.e. temperature as a function of the heating time, relevant for the individual measuring positions, are determined.

Whereas for monitoring alloy melts for diecasting, in essence temperature measurement is used, measurement of the electrical heating energy applied during preheating constitutes a further option for monitoring the state of the rod during thixotropic moulding.

For monitoring a thixotropic moulding process, metallographic tests to determine the distribution of the liquid proportion can be undertaken on the thixotropic rod, for example by cutting the rod at various longitudinal positions across its longitudinal axis and determining the liquid proportion in the rod cross-section, for example as a function of the distance from the centre of the rod. The aim of such investigations is to optimise the heating curve in such a way that a predetermined liquid proportion is achieved as homogeneously as possible within the entire thixotropic rod in the shortest possible time. Calorimetric measurements can also be performed in order to determine the mean liquid proportion.

With respect to the parameters of the diecasting or thixotropic moulding process, the temperatures of the casting chamber, the sprue channels and the mould cavity are normally measured, and the pressure and humidity in the evacuated mould cavity are ascertained.

The formerly habitual determination of the parameters with respect to the diecasting or thixotropic moulding material and of the diecasting or thixotropic moulding process is complex and unsuitable for monitoring the diecasting or thixotropic moulding processes under production conditions.

SUMMARY OF THE INVENTION

The invention seeks to solve the problem of creating a method for monitoring the process during diecasting or thixotropic moulding of metals, with which the manufacture of diecastings or thixotropic mouldings can be reliably monitored under production conditions.

This problem is solved according to the invention in that the temporal development of the moulding pressure p(t) is measured and the time-related speed of the casting piston v(t) is determined, and the energy E(t) supplied by the casting piston as a function of the process time t, and the total energy $E_{tot}$ supplied by the casting piston during the diecasting or thixotropic moulding process, are calculated on the basis of the time-related development of the moulding pressure p(t) and the casting piston speed v(t), and the total energy $E_{tot}$ is used as a parameter for monitoring the diecasting or thixotropic moulding process.

The method according to the invention is especially suitable for diecasting or thixotropic moulding of aluminum alloys or magnesium alloys.

The method according to the invention is especially suitable for horizontal thixotropic moulding installations and horizontal diecasting plants, i.e. devices in which the casting chamber lies horizontal.

The method according to the invention is based on the fact that the total energy supplied through the casting piston represents an extremely relevant checking parameter for the entire diecasting or thixotropic moulding process. The method according to the invention to determine the energy supplied through the casting piston and the use in particular of the total energy value as a parameter for process monitoring is also known as the RTIM process (Real Time Injection Monitoring).

The preheating temperature and the corresponding temperature distribution in the metal rod, and the measure of the energy supplied through the casting piston in the case of thixotropic moulding, are especially relevant, since a specific liquid proportion which remains within a narrow variation range must be observed. For example, in the case of thixotropic moulding, it may be concluded from a high total energy supplied by the casting piston, that the viscosity of the thixotropic material is too low, which can be caused either by a too small liquid proportion or too low shearing forces during the thixotropic moulding process.

The method according to the invention permits better process stability, optimisation of the process parameters, improvement of product quality and a reduction in the reject rate.

The method according to the invention is used with particular preference for thixotropic moulding. Here, it serves in particular to determine the optimum liquid proportion of the thixotropic metal rod under production conditions. The optimum mean liquid proportion in the thixotropic metal rod in this case is 40–55% by weight. If the liquid proportion is too high, the thixoforming of thixotropic material takes place virtually under the same conditions as the diecasting of liquid metal alloys, so that for example the benefit of a low shrinkage of thixotropic material during cooling in the mould cavity is lost, or else the shearing of the oxide skin surrounding the thixotropic rod is made more difficult or impossible. Moreover, the dimensionally stable insertion into the casting chamber of a thixotropic rod with a high liquid proportion is difficult and in most cases is not reproducible.

A further important factor in the case of thixotropic moulding is the homogeneity of the thixotropic condition, i.e. the distribution of the liquid proportion over the length of the rod and the rod cross section, whereby this homogeneity is generally better, the slower the preheating process is undertaken; on the other hand, the shortest possible heating time is desired for economic reasons.

During the inventive activity it was found for thixotropic moulding, that by determining the total energy supplied through the casting piston to the thixotropic material during a thixotropic moulding process, the liquid proportion existing after the preheating and its homogeneity within the thixotropic rod can be indirectly monitored.

The method according to the invention is further suitable in particular for monitoring the preheating furnaces, i.e. by determining the total energy for each charge, i.e. for each complete diecasting or thixotropic moulding process, with thixotropic rods or diecasting material from a specific preheating furnace, it is possible to ascertain and monitor the regularity of this furnace. Furthermore, by determining the total energy for each charge with thixotropic rods or diecasting material from different preheating furnaces, the regularity of the heating power of the furnaces concerned can be compared and monitored.

Determining the total energy for each charge moreover permits the pre-solidification to be checked. Pre-solidification, i.e. premature material solidification, can for example be caused by too low a casting chamber and/or mould temperature, and is undesirable due to the resulting usually poor casting properties. Thanks to the possibility of ascertaining pre-solidification, it is possible indirectly to check the temperatures of the casting chambers and the casting mould. Furthermore, inferences can be drawn indirectly on the design of the mould cavity.

Furthermore, determination of the total energy for each charge also allows investigation of pressure losses during the charge due, for example, to tribological properties, and thus provides information in relation to the friction of the casting piston, the mechanical condition of casting pistons and/or of the casting chamber, piston lubrication and the effect of parting compounds. Consequently, determination of the total energy supplied to the system by the casting piston during a charge also serves to monitor the tribological conditions in relation to the casting piston and the casting chamber.

According to the invention, the process time-dependent speed v(t) of the casting piston can either be directly measured or determined by measuring the process time-dependent casting piston position s(t).

On the basis of the time-dependent position measurement s(t) of the casting piston, the time-dependent speed v(t) of the casting piston can be calculated using the function $$v(t)=ds(t)/dt$$

i.e. by differentiating the time-dependent casting piston position s(t) after time t. The speed of the casting piston on the basis of the position measurement s(t) is suitably calculated at discrete, for example equidistant times. Suitably the speed is calculated at 50 to 800, preferably at 180 to 500 and in particular at 250 to 400 discrete process times. The discrete speed values thus ascertained are preferably filtered using numeric methods. Furthermore, a constant speed curve v(t) is calculated, preferably using numeric interpolation methods.

The time-dependent energy supplied by the casting piston during two process times tx and ty can be calculated according to the integral function $$E_{t,y}(t) = A \cdot \int_{t_x}^{t_y} p(t) \cdot v(t) dt$$

where A is the area of the casting piston facing the continuous casting or thixotropic moulding material.

The energy E(t) supplied by the casting piston, as a function of process time t, can be calculated according to the integral function $$E(t) = A \cdot \int_{t_0}^{t} p(t) \cdot v(t) dt$$

and the total energy $E_{tot}$ supplied through the casting piston during the diecasting or thixotropic moulding process can be calculated by the integral function $$E_{tot} = A \cdot \int_{t_0}^{t_4} p(t) \cdot v(t) dt$$

where A is the area of the casting piston facing the diecasting or thixotropic moulding material and $t_0$ is the starting time t=0 of the diecasting or thixotrapic moulding process and $t_4$ the time at which the casting piston first assumes the speed v(t)=0 after $t_0$. At time $t_4$, the actual diecasting or thixotropic moulding process is completed and the mould cavity is filled in order to balance out any material shrinkage during cooling of the moulding in the mould cavity and to avoid corresponding incomplete mould filling, the pressure on the diecasting or thixotropic moulding mass is also maintained for a short time after $t_4$, so that the casting piston can make a further translational movement, where the casting piston speed can again fall to zero.

Instead of measuring the time-dependent casting piston position s(t), the time-dependent development of the speed v(t) can be directly measured and used for calculation of the energy E(t) supplied by the casting piston or the total energy $E_{tot}$.

The piston position s(t) or the piston speed v(t) and the development of the pressure p(t) during the entire diecasting or thixotropic process are preferably continuously measured.

An important feature of the invention is also the fact that the measurements s(t) and p(t), or v(t) and p(t), and the calculation of v(t), E(t) and $E_{tot}$ can be undertaken online during the process, so that the parameters are available immediately after the charge for corresponding correction measures, i.e. the measurement of s(t) or v(t) and p(t), and determination of v(t) and E(t) takes place in real time. A process window is available between two charges, which permits intervention via the undertaking of correction measures, since immediately after the charge the moulding has to be cooled again, the mould opened, the moulding removed from the diecasting or thixotropic moulding device and the casting chamber recharged with the diecasting or thixotropic moulding material. The casting chamber is preferably loaded with a thixotropic metal rod using a robot. The casting chamber is loaded with a liquid metal alloy for diecasting for example by opening a valve or plug in a trough, so that the liquid metal can flow into the casting chamber.

Preferably, in addition to total energy $E_{tot}$, the total energies $E_1$ to $E_4$ supplied by the casting piston can be determined for the following process stages:

in thixotropic moulding, the partial energy $E_1$ supplied by the casting piston during the period between time $t_0$ and time $t_1$ for moving the thixotropic metal rod in the casting chamber until the rod reaches the end of the casting chamber facing the mould, where $t_1$ is the time at which the metal rod reaches the end of the casting chamber; in a diecasting process, the partial energy $E_1$ is constantly zero;

in diecasting or thixotropic moulding, the partial energy $E_2$ supplied by the casting piston during the period between $t_1$ and time $t_2$ for deforming the thixotropic metal rod or the diecasting material, whereby $t_2$ is the time at which the diecasting or thixotropic moulding material fills the entire casting chamber cross section over its entire length;

in diecasting or thixotropic moulding, the partial energy $E_3$ supplied by the casting piston during the period between $t_2$ and time $t_3$ for filling the sprue channels, where $t_3$ is the time at which the sprue channels between the casting chamber and the mould cavity are all completely filled;

in diecasting or thixotropic moulding, the partial energy $E_4$ supplied by the casting piston during the period between $t_3$ and time $t_4$ for filling the mould cavity, where time $t_4$ is the time at which all parts of the mould cavity are completely filled and the speed of the casting piston has fallen to zero, i.e. $v(t_4)=0$.

In particular, ascertaining the partial energy $E_1$ permits the pre-solidification of the diecasting or thixotropic moulding material in the casting chamber to be determined. Moreover, $E_1$ in particular also provides information about the general tribological conditions, i.e. for example pressure losses due to friction, wear manifestations and lubrication, and thus serves for example to assess the effect of the parting compounds and lubricants, and furthermore provides information on the friction of the casting piston and its lubrication.

Normally, the casting piston of diecasting or thixotropic moulding installations is driven hydraulically. In diecasting or thixotropic moulding installations designed in this way, the time-dependent pressure development p(t) is particularly advantageously determined by simultaneously measuring the time-dependent pressure development $p_{GK}(t)$ at the casting piston surface facing the diecasting or thixotropic moulding material, and by measurement of the pressure development $P_{hyd}(t)$ in the hydraulic liquid, whereby preferably the pressure development $p_{GK}(t)$ is used for calculation of the energy supplied through the casting piston to the diecasting or thixotropic moulding material.

Since for the monitoring of the diecasting or thixotropic moulding process according to the invention and the corresponding process checking, it is not the absolute energy measurements E(t), $E_{tot}$, $E_1$ to $E_4$ which are important, but in essence the corresponding energy values for various thixotropic rods or diecasting material quantities from the same preheating furnace or from various preheating furnaces are compared, the pressure development $p_{hyd}(t)$ can also be used for calculation of the energy values E(t), $E_1$ to $E_4$ and $E_{tot}$.

$p_{hyd}(t)$ describes the total pressure exerted on the casting piston. However, this does not correspond to the pressure exerted on the diecasting or thixotropic moulding material, since the casting piston itself is exposed to a certain friction in the casting chamber.

As a result, the simultaneous measurement of $p_{hyd}(t)$ and $P_{GK}(t)$ permits determination of the pressure lose $\Delta p=p_{hyd}(t)-p_{GK}(t)$ due to the friction of the casting piston, and therefore allows inferences to be drawn regarding the mechanical condition of the casting chamber and casting piston and the lubrication of the casting piston.

Whereas $E_{tot}$ permits global checking of the entire thixotropic moulding or diecasting process, the partial energy values $E_1$ to $E_4$ provide information on certain process parameters, such as have been described in the case of $E_1$ for example for the tribological conditions explained above or for ascertaining pre-solidification. $E_2$ is suitable for example for obtaining information on the necessary deformation energy and provides, in the case of thixotropic moulding for example, information about the condition of the rod, i.e. whether the thixotropic rod is too hard or too soft, or whether the liquid proportion is too high or too low. $E_3$ and $E_4$ on the other hand are suitable for example for monitoring the filling behaviour of the sprue channels and the mould cavity, and for example provide information on the effect of the parting compound and in the case of thixotropic moulding, also on the shearing forces acting on the thixotropic material.

In the case of thixotropic moulding or diecasting processes with RTIM process monitoring according to the invention, a report is preferably printed out for each work shift, which is normally of around 8 hours, where preferably the number of casting or thixotropic mouldings manufactured, i.e. the charge number n, the partial energies $E_1$ to $E_4$ and the total energy $E_{tot}$ are calculated for each charge and shown on the report printout. Also, preferably the mean total energy $E_{tot.m}$ and the standard deviation $\sigma_n$ for all n charges with diecasting or thixotropic moulding material from the same preheating furnace are ascertained and printed out.

The mean total energy $E_{tot.m}$ for a number n of charges with thixotropic moulding or diecasting material from the same furnace K is calculated for example as an arithmetic mean as:

$$E_{tot,m} = \frac{1}{n}\sum_{i=1}^{n} E_{tot,i}$$

The standard deviation may then be calculated as $$\sigma_n = \sqrt{\frac{1}{n-1}\sum_{i=1}^{n}(E_{tot,i} - E_{tot,m})^2}$$

Also, preferably the relevant scatter can be calculated according to $$\sigma_{rel}=100\%\cdot\sigma_n^2/E_{tot.m}$$

From an assessment of the resulting mouldings and the corresponding comparison of the energy values $E_{tot}$ and $E_1$ to $E_4$ and of the mean and standard deviation, it is possible to conclude what energy range is admissible in order to obtain a satisfactory moulding quality. Therefore with respect to the energy values $E_{tot}$ and $E_1$ to $E_4$ a nominal value range for the thixotropic moulding or diecasting process can be determined, which can be used as a parameter for example for a process interruption, a change of preheating furnace, a calibration of the heating power of a preheating furnace, a correction of the casting curve or triggering of a monitoring alarm.

With respect to the device, the present invention is based on the task of providing a thixotropic or diecasting device which permits monitoring of the manufacturing process under production conditions.

According to the invention, this is achieved by a diecasting installation comprising a casting chamber, a casting piston movable in the casting chamber, a mould with at least one mould cavity, and means for simultaneously determining a process time-dependent pressure p(t) and a process-time dependent position s(t) of the casting piston.

A diecasting or thixotropic moulding device according to the invention, in which the measuring devices permit continuous recording of the time-dependent pressure p(t) and continuous position measurement s(t), is especially preferred.

The measuring device to determine the position s(t) can also preferably have a device to measure the time-dependent speed v(t) of the casting piston, whereby the position of the casting piston $s(t_x)$ at time $t_x$ is determined as $$s(t_x) = \int_{t=0}^{t_x} v(t)dt$$

The device according to the invention is especially suitable for thixotropic moulding or diecasting using the method according to the invention for process monitoring.

BRIEF DESCRIPTION OF THE DRAWINGS

Further advantages, features and details of the invention are evident from the description below of FIGS. 1 to 8 using the example of thixotropic moulding, and based on the drawings, which diagrammatically show the following.

DETAILED DESCRIPTION OF THE PREFERRED EMBODIMENTS

Figure 1:
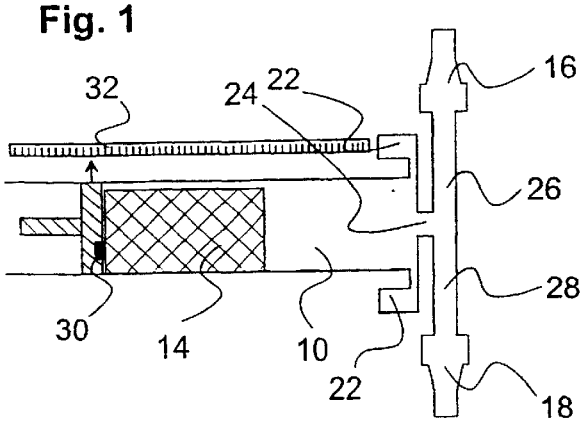
FIGS. 1 to 5 the temporal development of the process during thixotropic moulding in a horizontal thixotropic moulding installation.

FIGS. 1 to 5 show a vertical longitudinal section along the longitudinal axis through the casting chamber of a horizontal thixotropic moulding installation. The cylindrical casting chamber 10 is arranged horizontally and contains a casting piston 12, a radially symmetrical oxide pocket 22, a sprue opening 24, two sprue channels 26 and 28 and two mould cavities 16 and 18 attached thereto.

FIG. 1 shows the thixotropic moulding installation at time $t_0$=0, where a thixotropic metal rod 14 brought to the requisite temperature in a preheating furnace (not shown) is introduced into the horizontal casting chamber and the casting piston 12 is brought to the metal rod. FIG. 1 shows as an example a pressure sensor 30 attached to the casting piston surface facing the thixotropic metal rod 14. Furthermore, FIG. 1 shows a position or speed measurement device 32.

Figure 2:
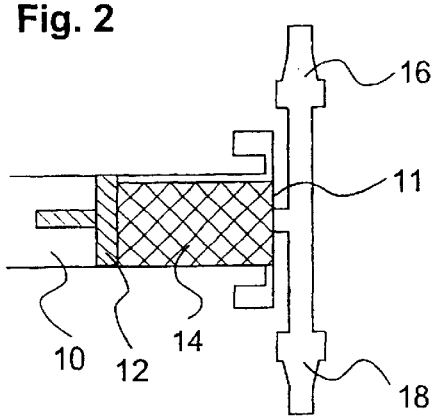

FIG. 2 shows the thixotropic moulding device at time $t_1$, at which the thixotropic metal rod 14 reaches the end 11 of the casting chamber on the mould side. Since the cross sectional area of the cylindrical thixotropic metal rod 14 is smaller than the cross sectional area of the casting chamber 10, the thixotropic rod 14 does not yet fill the entire cross sectional area of the casting chamber at time $t_1$.

Figure 3:
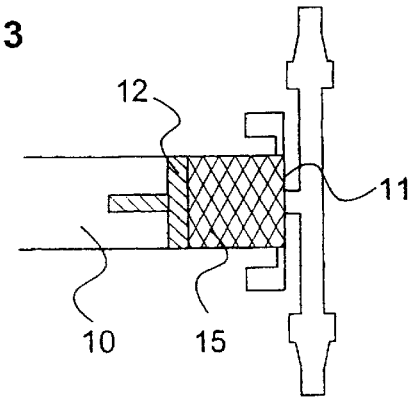

FIG. 3 shows the thixotropic moulding device at time $t_2$. At this time the thixotropic metal rod has lost its geometric structure and now has the shape of a thixotropic moulding mass 15. Time $t_2$ therefore designates the time at which the entire length of the thixotropic moulding mass or the thixotropic moulding material 15 fills the entire cross sectional area of the casting chamber, i.e. the thixotropic moulding mass 15 fills the entire space between casting piston 12 and the end 11 of the casting chamber 10 facing the mould, whereby at time $t_2$ substantially no thixotropic material has yet flowed through the sprue opening 24 or no oxidic edge material has flowed into the oxide pocket 22.

Figure 4:
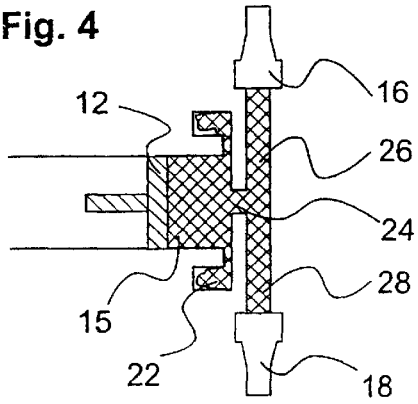

FIG. 4 shows the thixotropic moulding installation at time $t_3$. Time $t_3$ describes the time at which the sprue opening 24 and the sprue channels 26 and 28 are completely filled with thixotropic moulding material 15. The oxide pocket 22, which holds the oxide material located in the edge layer of the thixotropic metal rod 14, is already largely filled.

Figure 5:
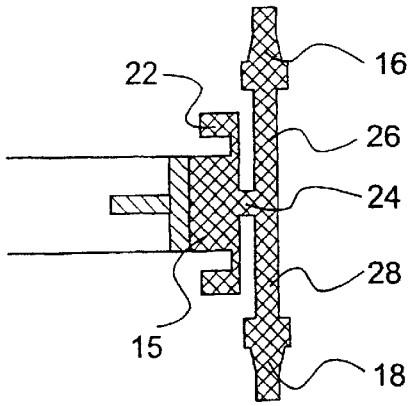

FIG. 5 shows the thixotropic moulding installation at time $t_4$. Time $t_4$ describes the final state of the actual thixotropic moulding process, i.e. the time before the mould is opened. At time $t_4$ the mould cavities 16 and 18 are completely filled with thixotropic mass 15 and the speed of the casting piston 12 has fallen to zero. During the subsequent cooling and hardening phase of the thixotropic moulding, the casting piston pressure can be maintained for a short time, in order to compensate for shrinkage during the cooling process by pressing on the thixotropic material, so that the casting piston can perform an additional movement after time $t_4$. At time $t_4$, in this example, the radially symmetrically designed oxide pocket 22 is completely filled with oxidic constituents of the original edge layer of the thixotropic rod 14.

In FIG. 6, the calculated total energy values of thixotropic moulding processes of individual thixotropic metal rods from the same preheating furnaces, i.e. the total energy values of individual charges, are shown in such a way that the total energy in each case is applied on the corresponding charge times is applied on the abscissa; the charge number of a charge corresponds to a certain time $t_x$, so that the ordinate corresponds to a time axis. The certain time $t_x$ can be predefined as desired, i.e. it may for example be defined as a starting time at which the casting piston starts for the thixotropic moulding process. Any other precisely definable time during a thixotropic moulding process may also be defined as the certain time $t_x$. The start of the casting piston at the beginning of each thixotropic moulding process has been selected for the values shown in FIG. 6.

The partial FIGS. a to h of FIG. 6 each show the ascertained total energy values for a number of charges, where the values for the thixotropic metal rods of a specific preheating furnace are shown separately, i.e. the views a to h reproduce the values for thixotropic metal rods from the same preheating furnaces.

Figure 6A:
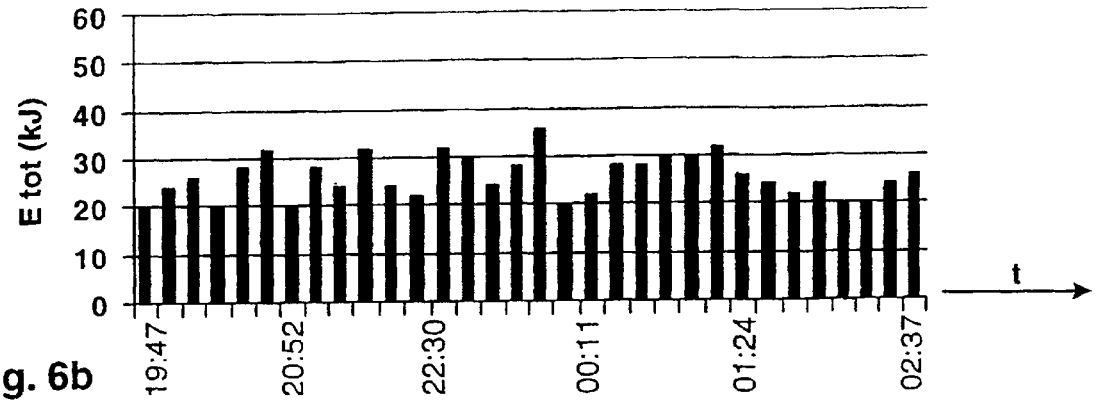
FIGS. 6 and 7 report printouts of RTIM process monitoring according to the invention.

FIG. 6*a* shows the total energies of 32 charges of thixotropic rods which were heated in a furnace no. 1. The start of the casting piston at the beginning of each thixotropic moulding process was selected as the specific time $t_x$. The figure covers charges during a period from 19:47 in the evening to 2:37 on the following day. The mean total energy of all 32 charges is 26.01 kJ with a relative scatter of ±16%.

Figure 6B:
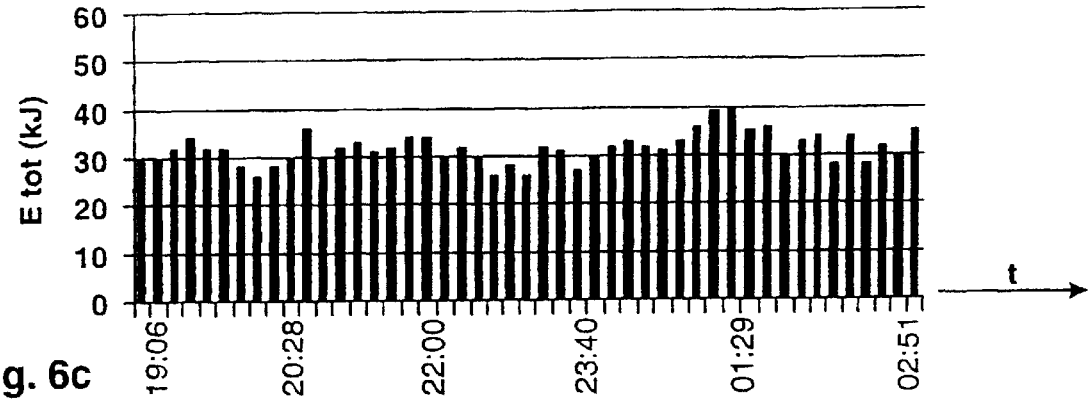

FIG. 6*b* shows the total energies of 46 charges with thixotropic rods which were heated in a furnace no. 5. The figure covers charges during a period from 19:06 in the evening to 2:51 on the following day. The mean total energy of all 46 charges is 31.97 kJ with a relative scatter of ±10%.

Figure 6C:
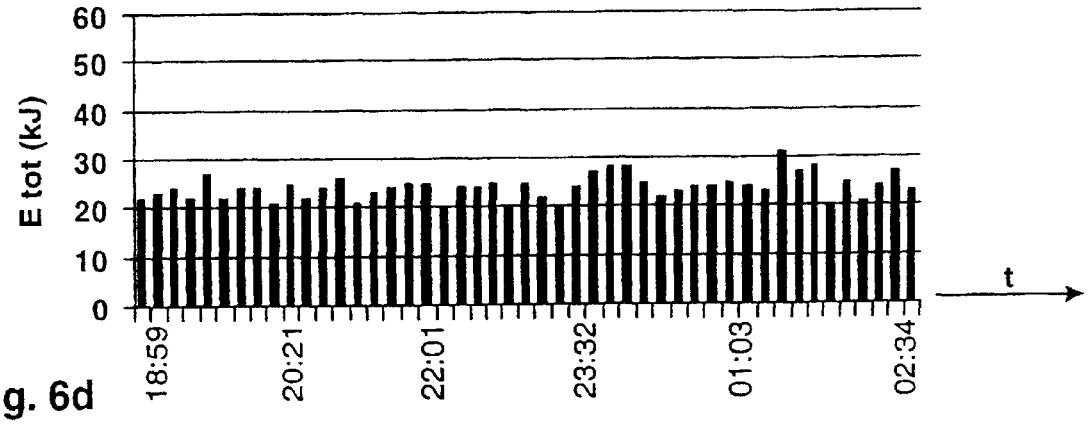

FIG. 6*c* shows the total energies of 47 charges with thixotropic rods which were heated in a furnace no. 6. The figure covers charges during a period from 18:59 in the evening to 2:34 on the following day. The mean total energy of all 47 charges is 23.91 kJ with a relative scatter of ±9%.

Figure 6D:
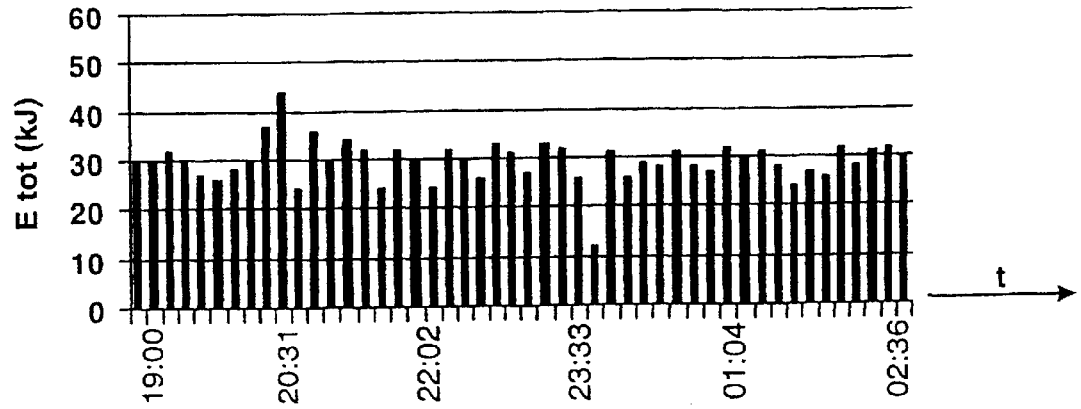

FIG. 6*d* shows the total energies of 48 charges with thixotropic rods which were heated in a furnace no. 7. The figure covers charges during a period from 19:00 in the evening to 2:36 on the following day. The mean total energy of all 48 charges is 30.58 kJ with a relative scatter of ±15%.

Figure 6E:
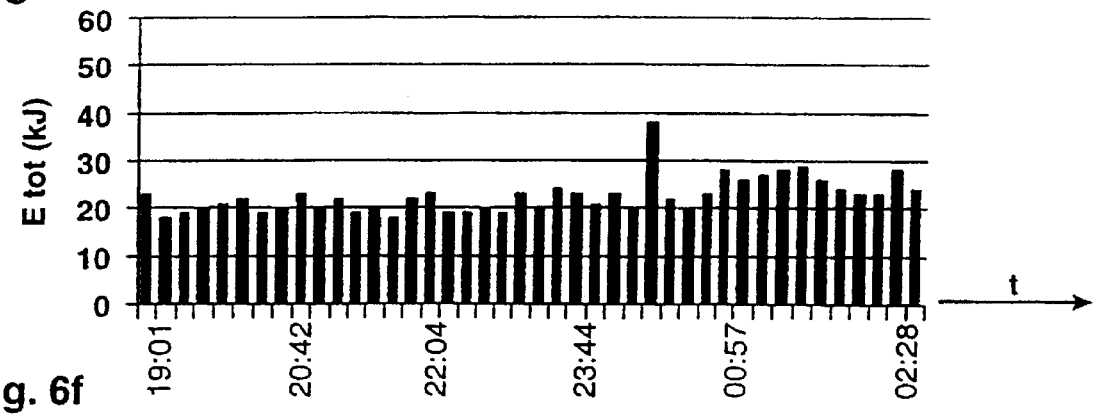

FIG. 6*e* shows the total energies of 42 charges with thixotropic rods which were heated in a furnace no. 9. The figure covers charges during a period from 19:01 in the evening to 2:28 on the following day. The mean total energy of all 42 charges is 23.53 kJ with a relative scatter of ±16%.

Figure 6F:
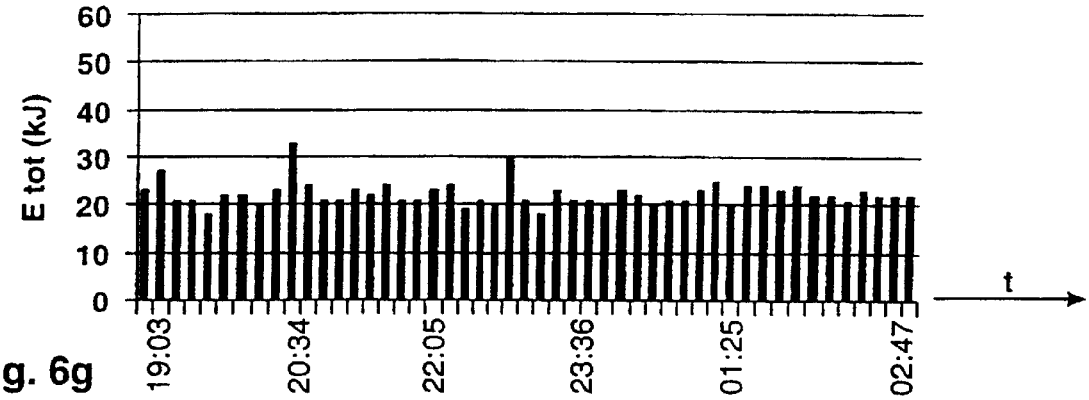

FIG. 6*f* shows the total energies of 49 charges with thixotropic rods which were heated in a furnace no. 10. The figure covers charges during a period from 19:03 in the evening to 2:47 on the following day. The mean total energy of all 49 charges is 23.03 kJ with a relative scatter of ±12%.

Figure 6G:
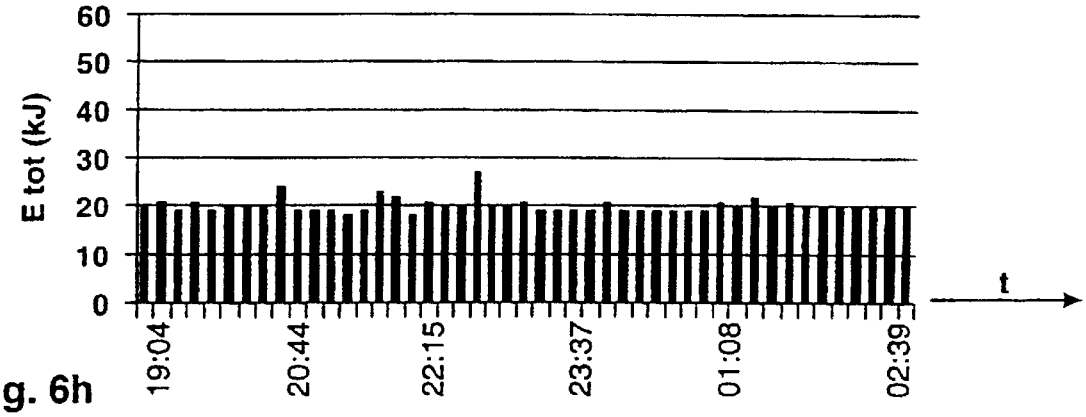

FIG. 6*g* shows the total energies of 47 charges with thixotropic rods which were heated in a furnace no. 11. The figure covers charges during a period from 19:04 in the evening to 2:39 on the following day. The mean total energy of all 47 charges is 20.38 kJ with a relative scatter of +8%.

Figure 6H:
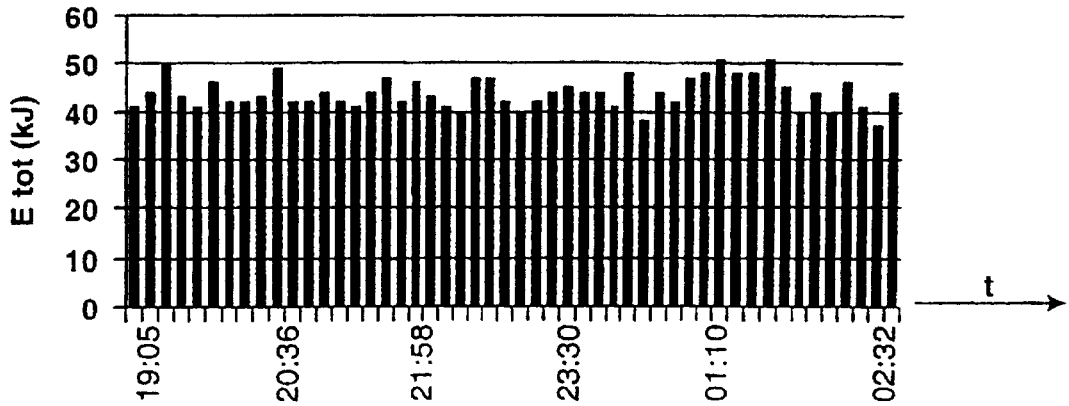

FIG. 6*h* shows the total energies of 51 charges with thixotropic rods which were heated in a furnace no. 12. The figure covers charges during a period from 19:05 in the evening to 2:32 on the following day. The mean total energy of all 47 charges is 20.38 kJ with a relative scatter of ±7%.

Figure 7:
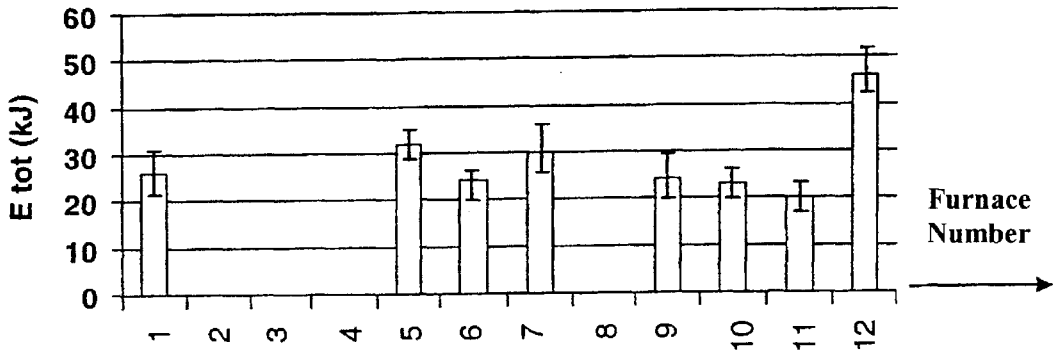

FIG. 7 shows a bar graph of the mean total energies $E_{tot,i}$ (i=1 . . . 12, where i is the furnace number) for the thixotropic moulding test shown in FIG. 6 during a work shift of approx. 8 hours, where the standard deviations are still shown. Every bar in FIG. 7 therefore represents the total energy $E_{tot,i}$ per charge for thixotropic metal rods from furnace no. i averaged over all the charges during a work shift.

On the basis of the assessment of the resulting mouldings and the corresponding comparison of the mean total energy $E_{tot,i}$ or $E_{tot}$, it may be concluded which energy range is admissible for an adequate moulding quality. The resulting mouldings may for example be appraised by way of optical or microscopic assessment or by mate rial testing, material specific tests using for example micrographs, material analyses, structure tests etc. On the basis of the appraisal of the mouldings and the total energy values $E_{tot}$ known for their production and the values for the partial energies $E_1$ to $E_4$, a total energy nominal value range may for example be determined with respect to $E_{tot}$ for the thixotropic moulding or diecasting process. The nominal value range may then be used as a further parameter, whereby if the total energy value of a charge or of a number of charges falls outside this range, a process interruption, a change of preheating furnace or a re-calibration of the heating power of a preheating furnace may for example be undertaken.

Appraisal of the mouldings which have been manufactured using the thixotropic moulding process relating to FIG. 6, shows that in this case the total energy per charge must be between 35 kJ$\geqq E_{tot} \geqq$10 kJ, in order to achieve the required moulding quality. Close to the energy thresholds thus ascertained, both mouldings with the required moulding characteristics and mouldings with inadequate moulding characteristics can result. If the total energy value of a charge lies outside the energy range determined, there is a greater risk of producing a non-conforming moulding, i.e. of a moulding which does not exhibit the required moulding characteristics with respect to structure, dimensions etc. Consequently, the determination of the total energy for a charge represent& a measure for the probability of production of a good or poor moulding, i.e. a measure for the reject probability.

Figure 8:
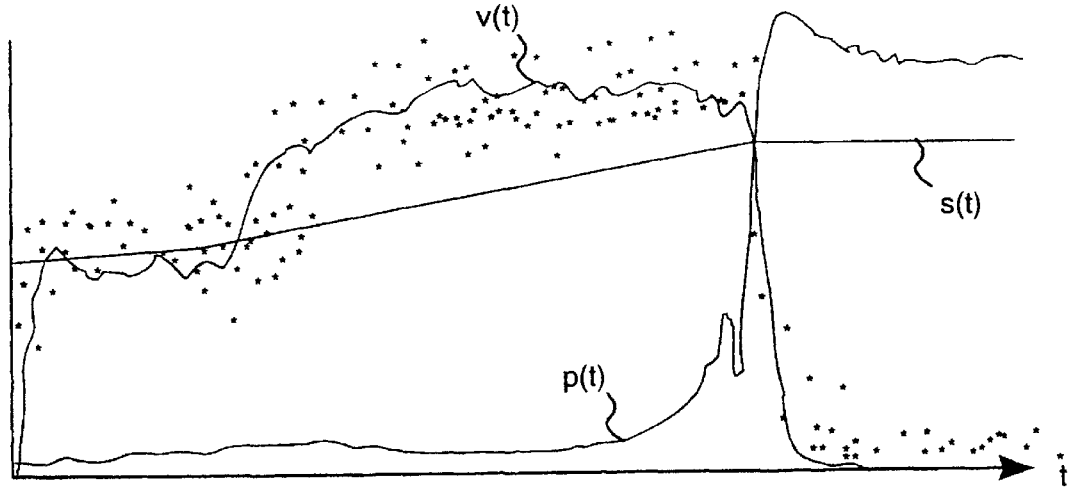
FIG. 8 a graphic report presentation of the measured and calculated values for the RTIM process according to the invention.

FIG. 8 shows an example of a graphic report presentation of the measured and calculated values for the RTIM process according to the invention, and shows firstly the measured path s(t) taken by the casting piston 12 and secondly the measured time-dependent pressure p(t) exerted by the casting piston 12 during a thixotropic moulding process, i.e. during a charge, and where the speed values v(t)=ds(t)/dt of the casting piston 12 ascertained at discrete times are entered. Moreover, the report presentation shown in FIG. 8 also shows a speed curve v(t), which is calculated by numerical filtering and flattening of the discrete speed values s(t)/dt.

What is claimed is:

1. A method for process monitoring during diecasting or thixotropic moulding of metals in a diecasting or thixotropic moulding installation which contains a casting chamber, a casting piston and a mould with a mould cavity, the method comprising the steps of:

measuring temporal development of moulding pressure p(t); determining time-related speed of the casting piston v(t); calculating energy E(t) supplied by the casting piston as a function of process time t, and calculating total energy $E_{tot}$ supplied by the casting piston during the diecasting or thixotropic moulding process based on development of the moulding pressure p(t) and the casting piston speed v(t); and using the total energy $E_{tot}$ as a parameter for monitoring the diecasting or thixotropic mould process, the step of calculating including calculating the energy E(t) supplied by the piston as a function of the process time t according to an integral function $$E(t) = A \cdot \int_{t_0}^{t} p(t) \cdot v(t) dt$$

and calculating the total energy $E_{tot}$ supplied by the casting piston during the diecasting or thixotropic moulding process with an integral function $$E_{tot} = A \cdot \int_{t_0}^{t_4} p(t) \cdot v(t) dt$$

where A designates an area of the casting piston facing the diecasting or thixotropic moulding material, $t_0$ designates a starting time t=0 of the diecasting or thixotropic moulding process and $t_4$ designates a time at which the casting piston assumes speed v(t)=0 for a first time after $t_0$.

2. A method according to claim 1, including determining the temporal pressure development p(t) by measuring a pressure $P_{GK}(t)$ at a casting piston surface facing the diecasting or thixotropic moulding material.

3. A method according to claim 1, wherein the casting piston is driven by hydraulic fluid, the step measuring the temporal pressure development p(t) includes determining the pressure development by measuring a pressure $P_{hyd}(t)$ in the hydraulic liquid.

4. A method according to claim 1, including determining the total energy $E_{tot}$ for a plurality of diecasting or thixotropic moulding processes using diecasting or thixotropic moulding material from a specific preheating furnace, and calculating a corresponding mean and a standard deviation from the total energy from the plurality of processes, and using the mean and standard deviation as further parameters.

5. A method according to claim 1, including measuring a time-dependent position s(t) of the casting piston and determining the speed v(t) of the casting piston as a derivation of the time-dependent casting piston position s(t) after time t at discrete times according to the function $$v(t)=ds(t)/dt$$

where the speed v(t) is determined at discrete process time points during the diecasting or thixotropic moulding process.

6. A method according to claim 5, wherein the speed v(t) is determined at 180 to 500 process time points.

7. A method according to claim 6, wherein the speed v(t) is determined at 250 to 400 process time points.

8. A method according to claim 1, wherein the calculating step includes calculating time-dependent energy $E_{x,y}(t)$ supplied by the casting piston during two process time points $t_x$ and $t_y$, where $t_x<t_y$, using the integral function $$Ex,\ y(t) = A \cdot \int_{tx}^{ty} p(t) \cdot v(t) dt.$$

9. A method according to claim 8, including calculating partial energies $E_1$ to $E_4$ for the following process stages:

a) in diecasting and thixotropic moulding, the partial energy $E_1$ supplied by the casting piston during a period from time to $t_0$ to time $t_1$ for moving a thixotropic metal rod or the diecasting material in the casting chamber until the metal rod reaches an end of the casting chamber facing the mould, where $t_1$ designates a time at which the thixotropic metal rod arrives at the end of the casting chamber;

b) in diecasting and thixotropic moulding, the partial energy $E_2$ supplied by the casting piston during a period from time $t_1$ to time $t_2$ for deforming the thixotropic metal rod or the diecasting material, where $t_2$ designates a time at which an entire length of the diecasting or thixotropic moulding material fills an entire cross sectional area of the casting chamber;

c) in diecasting and thixotropic moulding, the partial energy $E_3$ supplied by the casting piston during a period from time $t_2$ to time $t_3$ for filling sprue channels, where $t_3$ designates a time at which the sprue channels located between the casting chamber and the mould cavity are all entirely filled; and d) in diecasting and thixotropic moulding, the partial energy $E_4$ supplied by the casting piston during a period from time $t_3$ to time $t_4$ for filling the mould cavity, where $t_4$ designates a time at which the mould cavity is completely filled and the speed of the casting piston has fallen to zero.

10. A method according to claim 9, including calculating the total energy $E_{tot}$ as $E_{tot}=E_1+E_2+E_3+E_4$.

11. A method according to claim 1, wherein the casting piston is driven by hydraulic fluid, the method including determining the temporal pressure development p(t) results from measurement of a pressure $p_{hyd}(t)$ in the hydraulic liquid and simultaneously from measure of a pressure $p_{GK}(t)$ at a casting piston surface facing the diecasting or thixotropic moulding material, the pressure development $p_{GK}(t)$ being used to calculate energy values supplied by the casting piston, and determining an energy loss caused by friction up to time t by calculating the integral function $$E(t)_{Friction} = A \cdot \int_{to}^{t} [p_{hyd}(t) - p_{GK}(t)] \cdot v(t) dt.$$

12. A method for process monitoring during diecasting or thixotropic moulding of aluminum and magnesium alloys in a diecasting or thixotropic moulding installation which contains a casting chamber, a casting piston and a mould with a mould cavity, the method comprising the steps of:

measuring temporal development of moulding pressure p(t); determining time-related speed of the casting piston v(t); calculating energy E(t) supplied by the casting piston as a function of process time t, and calculating total energy $E_{tot}$ supplied by the casting piston during the diecasting or thixotropic moulding process based on development of the moulding pressure p(t) and the casting piston speed v(t), and using the total energy $E_{tot}$ as a parameter for monitoring the diecasting or thixotropic moulding process, the step of calculating including calculating the energy E(t) supplied by the piston as a function of the process time t according to an integral function $$E(t) = A \cdot \int_{t_0}^{t} p(t) \cdot v(t) dt$$

and calculating the total energy $E_{tot}$ supplied by the casting piston during the diecasting or thixotropic moulding process with an integral function $$E_{tot} = A \cdot \int_{t_0}^{t_4} p(t) \cdot v(t) dt$$

where A designates an area of the casting piston facing the diecasting or thixotropic moulding material, $t_0$ designates a starting time t=0 of the diecasting or thixotropic moulding process and $t_4$ designates a time at which the casting piston assumes speed v(t)=0 for a first time after $t_0$.

* * * * *